US006371485B1

(12) United States Patent
Daines

(10) Patent No.: US 6,371,485 B1
(45) Date of Patent: Apr. 16, 2002

(54) CARD GAME METHOD

(75) Inventor: Shirley Daines, Red Deer (CA)

(73) Assignee: Canadian (21) Stook Ltd., Red Deer (CA)

( * ) Notice: Subject to any disclaimer, the term of this patent is extended or adjusted under 35 U.S.C. 154(b) by 0 days.

(21) Appl. No.: 09/681,649

(22) Filed: May 16, 2001

(30) Foreign Application Priority Data

Apr. 17, 2001 (CA) ..... 2344099

(51) Int. Cl.[7] ..... A63F 1/00
(52) U.S. Cl. ..... 273/303; 273/292
(58) Field of Search ..... 273/303, 292, 273/309, 294; 463/13

(56) References Cited

U.S. PATENT DOCUMENTS 4,926,327 A * 5/1990 Sidley ..... 364/412
5,265,882 A * 11/1993 Malek ..... 273/292
5,328,189 A * 7/1994 Malek ..... 273/292
5,380,012 A * 1/1995 Jones et al. ..... 273/292
5,382,025 A * 1/1995 Sklansky et al. ..... 273/292
5,395,120 A * 3/1995 Malek ..... 273/292
5,549,301 A * 8/1996 Gerrard ..... 273/305
5,628,514 A * 5/1997 Nguyen et al. ..... 273/292
5,632,487 A * 5/1997 Nguyen ..... 273/292
5,810,354 A * 9/1998 Banyai ..... 273/292
5,868,392 A * 2/1999 Kraft ..... 273/292
5,868,619 A * 2/1999 Wood et al. ..... 463/13
5,951,012 A * 9/1999 Feola ..... 273/292
5,954,336 A * 9/1999 Goossens et al. ..... 273/309
6,102,403 A * 8/2000 Kaufman ..... 273/292
6,135,453 A * 10/2000 Srichayaporn ..... 273/292
6,241,250 B1 * 6/2001 Webb ..... 273/292

* cited by examiner

*Primary Examiner*—Benjamin H. Layno
*Assistant Examiner*—Dolores R. Collins
(74) *Attorney, Agent, or Firm*—Bennett Jones LLP

(57) ABSTRACT

A method of playing a five-card, high-low card game includes dealing a player a five card hand face up and determining if the hand is high or low by the number of low (Ace to 6) card compared with the number of high (8 to King) cards in the hand. Sevens are neutral and are replaced in the hand. The player may place a bet on high or low, prior to being dealt the hand.

12 Claims, No Drawings

CARD GAME METHOD

SUMMARY OF INVENTION

The present invention relates to a method of playing a card game in a casino environment. More particularly, the invention relates to live table and electronic methods of playing a five-card high-low card game.

In one aspect, the invention comprises a method of playing a game of cards comprising the steps of: (a) providing at least one standard deck of cards; (b) allowing the player to place a bet on either high or low; (c) dealing a hand of five cards face up to the player; (d) determining if the hand is a high hand or a low hand where if the number of high cards exceeds the number of low cards then the hand is high or if the number of low cards exceeds the number of high cards then the hand is low, wherein aces, 2s, 3s, 4s, 5s and 6s are low cards and 8,s, 9s, 10s and face cards are high cards and wherein 7's are neutral cards and replaced with another card; and (e) collecting the player's bet if the bet is a losing bet or paying the player's bet if the bet is a winning bet.

In one embodiment, the invention may further comprise the step of paying a bonus to a player who has placed a winning bet and has 3 or more 7's in the player's hand. The player may be allowed to place a sweep bet in addition to the high or low bet, wherein a bonus is paid to a player whose hand is comprises of all low cards or all high cards and the player has otherwise placed a winning high or low bet.

DETAILED DESCRIPTION

When describing the present invention, all terms not defined herein have their common art-recognized meanings. The term "live casino game" is intended to encompass a game in which the house acts as the banker, the house collecting all losing wagers and paying all winning wagers. The dealer is employed by the house and each player plays exclusively against the house.

The method of the present invention is intended to be practiced in a casino or gaming house environment. The basic premise of the game is to allow the player to bet that a five-card hand dealt to the player is either a high hand or a low hand. Whether a particular hand is high or low depends on the number of high or low cards in the hand. Aces and all cards less than 7 are considered low cards and face cards and all cards higher than 7 are high cards. Seven's are neutral and are replaced with an additional card if they are dealt to the player. Therefore, a high hand has more high cards than low cards. Conversely, a low hand has more low cards than high cards.

The dealer invites each player to place a bet on either high or low. The dealer shuffles the cards and deals five cards face up to each player. The dealer uses at least one standard deck of cards. Preferably, there are at least four decks of cards to minimize the possibility that a player could "count" cards to obtain an advantage. More preferably, eight decks of cards should be used. If the player has placed a high bet and receives a high hand, or has placed a low bet and receives a low hand, then that player's bet is paid, less a house commission, which may be 5% of the amount bet. If the player's bet is incorrect, the dealer simply collects the player's bet.

As will be apparent, the game may be played with any odd number of cards in the player's hand. In a preferred embodiment, five cards are dealt to the player.

In one embodiment, a bonus may be paid to a player who has placed a winning bet based on the number of 7's which were dealt to the player. In one embodiment, if a player received three 7's, a bonus of five times the player's bet may be paid. If a player receives four 7's, then a bonus of 10 to 50 times the bet may be paid. If a player receives five 7's, then a bonus of 30 to 100 times the bet may be paid. No commission is collected from such bonuses. Bonuses are not paid if the player has not won the high-low bet.

In one embodiment, the player may place a sweep bet in addition to the high-low bet. The player wins the sweep bet if all five cards in the player's hand are low or high. A successful sweep bet may pay a bonus of 15 times the amount wagered and no commission is collected. In one embodiment, the sweep bet must be be made each time a hand is dealt as it does not automatically stay from hand to hand. Sweep bets may be paid regardless of whether or not the player has won the high-low bet.

As is apparent to one skilled in the art, the methods disclosed herein may be implemented at a live table game or electronically in an electronic video type gaming device, of the same general type disclosed in U.S. Pat. Nos. 4,948,134; 5,022,653; 5,377,973; 5,374,067; and 5,382,025. In the electronic version, the hand(s) of the player(s) take the form of video representations of playing cards displayed on a screen, under the control of a microprocessor operating under a suitable program.

As will be apparent to those skilled in the art, various modifications, adaptations and variations of the foregoing specific disclosure can be made without departing from the scope of the invention claimed herein.

What is claimed is:

1. A method of playing a game of cards comprising the steps of:

(a) providing at least one standard deck of cards;

(b) allowing the player to place a bet on either high or low;

(c) dealing a hand of an odd number of cards face up to the player;

(d) determining if the hand is a high hand or a low hand where if the number of high cards exceeds the number of low cards then the hand is high or if the number of low cards exceeds the number of high cards then the hand is low, wherein aces, 2s, 3s, 4s, 5s and 6s are low cards and 8s, 9s, 10s and face cards are high cards and wherein 7's are neutral cards and replaced with another card; and (e) collecting the player's bet if the bet is a losing bet or paying the player's bet if the bet is a winning bet.

2. The method of claim 1 further comprising the step of paying a bonus to a player who has placed a winning bet and has 3 or more 7's in the player's hand.

3. The method of claim 1 further comprising the step of allowing the player to place a sweep bet in addition to the high or low bet, wherein a bonus is paid to a player whose hand is comprises of all low cards or all high cards and the player has otherwise placed a winning high or low bet.

4. The method of claim 1 wherein at least 4 standard decks of cards are used.

5. The method of claim 1 wherein a winning bet pays even money less a commission.

6. The method of claim 5 wherein the commission is 5% of the amount of the bet.

7. The method of claim 2 wherein five cards are dealt to the player and three 7's pays 5:1, four 7's pays 10:1 to 50:1 and five 7's pays 30:1 to 100:1, with no commission.

8. The method of claim 7 wherein four 7's pays 10:1 and five 7's pays 30:1.

9. The method of claim 4 further comprising the step of recombining and shuffling all cards after each hand is dealt and played.

10. The method of claim 1 wherein three cards are dealt to the player.

11. The method of claim 1 wherein five cards are dealt to the player.

12. The method of claim 1 wherein seven cards are dealt to the player.

* * * * *